United States Patent [19]

Sullivan

[11] 3,963,374

[45] June 15, 1976

[54] WELL PUMP CONTROL

[76] Inventor: Robert E. Sullivan, 8007 Mullins, Houston, Tex. 77036

[22] Filed: Oct. 24, 1972

[21] Appl. No.: 300,129

[52] U.S. Cl. ..... 417/12; 417/40

[51] Int. Cl.[2] ..... F04B 49/00

[58] Field of Search ..... 417/40, 12, 43, 44, 417/41; 200/84 R; 73/322

[56] References Cited

UNITED STATES PATENTS

| | | | |
|---|---|---|---|
| 1,574,502 | 2/1926 | Matthews, Jr. et al. | 417/44 X |
| 2,280,930 | 4/1942 | Reeves | 417/40 |
| 2,316,494 | 4/1943 | Tipton | 417/12 X |
| 3,247,798 | 4/1966 | Glasgow et al. | 417/43 |
| 3,276,380 | 10/1966 | Stevenson | 417/40 |
| 3,366,063 | 1/1968 | Cottrell | 417/40 X |

*Primary Examiner*—William L. Freeh
*Attorney, Agent, or Firm*—Fulbright & Jaworski

[57] ABSTRACT

A pump control comprising a control circuit having a timer which periodically closes the control circuit and hence an energizing electric circuit to an electric motor driving the pump, for predetermined intervals of time, and a float assembly having a vertically movable float surrounded by a vertical guide and shield having openings adjacent its bottom. Inlet and outlet lines extend upwardly through its bottom and establish an upward liquid level in the float chamber and provide support. A reduced flow drain line at the bottom of the float chamber drains liquid to establish a lower liquid level. A removable top closes the float chamber, which top carries a switch actuated by a float stem extending through it so that movement of the float in response to liquid levels closes the control circuit and thus the energizing circuit to the electric motor and opens the circuit to the timer when the float is in an upper position, and opens the control circuit to the energizing circuit to the motor and closes the circuit to the timer when the float is in a lower position. The float is located out of the path of fluid flowing into and through the float chamber and is shielded by the vertical guide so that surges or flow of gas do not affect operation of the float.

9 Claims, 2 Drawing Figures

WELL PUMP CONTROL

BACKGROUND OF THE INVENTION

A number of pump controls have been proposed for controlling the pumping of oil wells so that when the wells "pump off" or "pump dry", that is do not pump liquid, the pump is stopped as there is a considerable amount of added expense or cost per barrel of coil pumped when no oil is being produced. Also, pumping dry wears out downhole pumps, sucker rods, uses more electricity and the like, and wears out packing around the sucker rods thus causing leakage of oil and gas to the atmosphere and surrounding environment.

These prior pump control systems have not been entirely satisfactory in that many of them simply monitor what the pump is doing and are adversely affected by the geometry of the pump parts, many are affected by surges or flow of gas, others utilize a sensing device which do not always distinguish between oil and gas, which is affected by wet gas, paraffin and other solids build-up, and the like. Also, many of these pump controls are complicated, expensive, require extensive modifications to well pumping installations and are not reliable in operation for various well pumping conditions. Those prior pump controls which do not effectively stop the pump when it pumps off causes undue wear on the packing causing leakage of oil and gas to the atmosphere and surrounding environment. Various of the foregoing proposals for pump controls are illustrated and described in the following U.S. Pat. Nos. 2,316,494; 2,456,456; 2,550,093; 2,741,986; 3,091,179; 3,274,940; 3,299,817; and 3,549,276.

It would be highly advantageous to provide a relatively simple, inexpensive and reliable pump control which monitors the liquid being pumped and acts in response thereto for controlling the pump, which is unaffected by flow or surges of gas, wet or dry, and which can be installed in existing pumping installations with a minimum of modification or adaptation. The present invention is directed to such a pump control.

Accordingly, it is an object of the present invention to provide a pump control for a pump driven by an electric motor which controls the pump in response to liquid being pumped, which is unaffected by flow or surges of gas, wet or dry, and does not act in response to the pumping action of the pump.

A further object of the present invention is the provision of such a pump control which does not utilize a sensor which is adversely affected by paraffin or other solid build-up, vibration, moisture, gas and the like.

Yet a further object of the present invention is the provision of a pump control for controlling an electric motor-driven pump for pumping oil from a well through a horizontal discharge line, which may be attached to and supported by the discharge line with a minimum of modification or adaptation of existing well installations, and which may be used with either a horizontally-disposed or a vertically-disposed check valve downstream of the pump control.

Yet a further object of the present invention is the provision of a pump control which automatically stops the pump after it has pumped off thereby minimizing wear on the packing at the well head about the string of sucker rods thereby minimizing leakage of oil and gas to the atmosphere and surrounding environment.

A still further object of the present invention is the provision of a relatively inexpensive and reliable float control which may be readily attached to and installed on normal well-pumping installations with a minimum of adaptation and expense.

A still further object of the present invention is the provision of such a well control including a float assembly having a float located out of and shielded from the direct inflow of fluid into the float chamber thereby preventing the direct inlet flow adversely affecting movement of the float with changes in the liquid level.

Yet a further object of the present invention is the provision of such a pump control which may be readily and easily installed with a minimum of adaptation on the horizontal portion of the discharge line of a typical pump installation.

Yet a further object of the present invention is the provision of such a pump control having a time delay which functions after loss of fluid from the well to keep the pump operating for a short period of time thus guarding against pump shut off due to a temporary loss of liquid from the well and allowing the additional pumping action to clear the liquid from the float chamber through a drain line thereby causing the float to be lowered and to actuate a switch to shut off the pump.

Other and further objects, features and advantages will appear from the following summary, brief description of the drawing, description of presently-preferred embodiments and the claimed subject matter.

SUMMARY OF THE INVENTION

In summary, the invention comprises a pump control for a pump driven by an electric motor for pumping liquid from a well through a discharge line and includes a float body having a float chamber, an inlet line into the float chamber attachable to a first segment of the discharge line, and an outlet line from the float chamber having an opening spaced above the bottom of the float chamber and attachable to a second segment of the discharge line downstream from the first segment so that liquid in the discharge line is pumped through the first segment, in the inlet line into the float chamber and out the outlet line into the second segment of the discharge line and establishes an upper liquid level in the float chamber. A draiin line is provided adjacent the bottom of the float chamber for draining liquid out of the float chamber and establishing a lower liquid level in the float chamber. The drain line has a reduced flow as compared to the flow in the outlet line which, preferably, is provided by a reducing flow valve. A float arranged for vertical movement is provided in the float chamber and is disposed out of and shielded from the inlet flow path to avoid the effect of inflow velocities, such as surges of gas, on the movement of the float with changes in liquid level. Preferably, a guide having a perforate lower portion extends upwardly from the bottom of the float chamber and surrounds and guides the float in its vertical movement. A top cover, which may be removed, is secured to the float body to close the float chamber and permits easy removal for cleaning, repair, replacement of parts and servicing.

A control electric circuit is provided for the power or energizing circuit to the electric motor which includes a timer which periodically closes the control circuit for predetermined intervals of time thereby actuating the pump for such periods of time. A switch is provided in the control circuit which is actuated by the vertical movement of the float and is arranged to close the control circuit to the timer when the float is in an upper position in response to an upper liquid level in the float chamber thereby causing the pump to pump, and to open the control circuit and thus the power circuit to the electric motor and to close the circuit to the timer when the pump is in a lower position in response to a lower or no liquid level in the float chamber thereby causing the timer to start again. Preferably, the switch and timer are carried by the top cover and the float has a stem slidably extending through the top cover for actuation of the switch as previously explained. Also, preferably the inlet and outlet lines to the float chamber are attached to the horizontal portion of the discharge line and support the float assembly, switch and timer in position. Thus, the pump control may be utilized with a check valve disposed in a downstream horizontal portion or vertical leg of the discharge line.

DETAILED DESCRIPTION OF PRESENTLY-PREFERRED EMBODIMENTS OF THE INVENTION

Figures 1, 2:
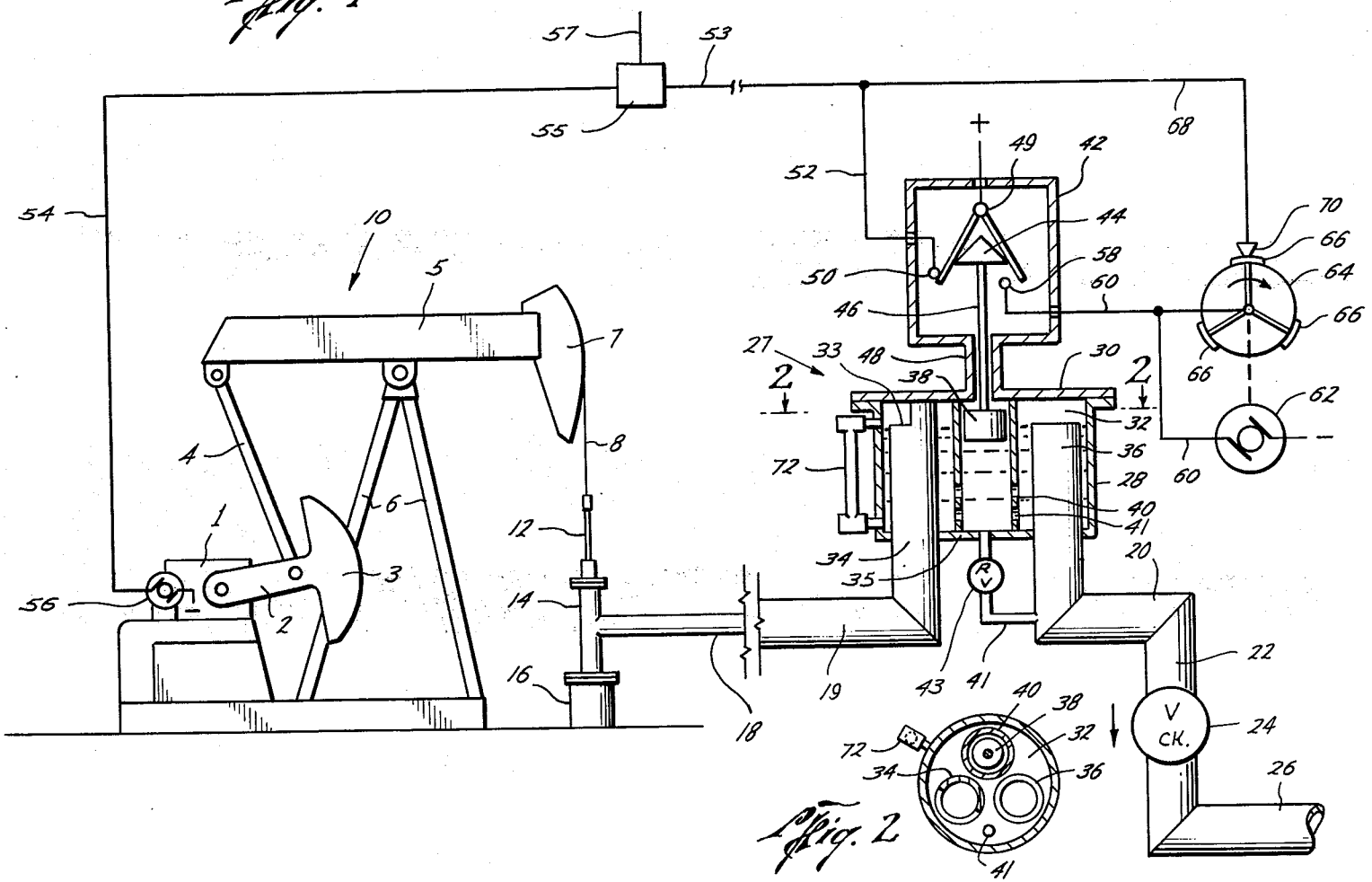
FIG. 1 of the drawing is a schematic, side elevational view, of a well pumping installation, the pump control being enlarged and partly in section and laid out in the plane of the paper for ease of illustration.
FIG. 2 is a cross-sectional view of the float assembly illustrating a preferred arrangement of the float assembly.

Referring now to the drawing, the reference numeral 10 generally illustrates a typical pumping assembly which includes the pump gear box 1, which drives the crank arm 2 having the counter-balance 3 at its outer end, which crank arm 2 drives the pittman 4, which in turn, drives the walking beam 5 supported by the standard 6, which causes the horse's head 7 to be swung upwardly and downwardly thereby raising and lowering the cable 8 attached to the sucker rod string 12 extending through the well head connection 14 into the cased well 16. The sucker rod string 12 extends downwardly into the cased well 16 and has the usual pump members attached to it so that as the sucker rod string 12 is reciprocated, it pumps liquid from the well 16 into the well head connection 14 and out the horizontally-disposed discharge line 18. No more detailed description of the pumping assembly is given or deemed necessary as the pump control of the present invention may be utilized on any type of pumping assembly that is driven by an electric motor and the pump assembly illustrated in the drawing is typical and representative and is given for purposes of illustration.

The pump control is generally designated by the reference numeral 27. For purposes of clarity of and to shorten the disclosure, various nuts, bolts and connecting parts are not shown, and the pump control is generally shown in schematic form. It will be understood, of course, that the various parts of the pump control assembly are connected together, can be disconnected for assembly and disassembly, and in the commercial practice parts are removably connected together so that the pump control assembly 27 may be readily secured to the discharge line 18, the control can be assembled and can be disassembled for repairs, replacement, cleaning, servicing and the like.

The pump control includes a generally cylindrical float body 28 removably closed by the top cover 30 by connecting members, not shown, to form the generally cylindrical float chamber 32. A generally L-shaped inlet line 34 is removably connected, by means not shown, to a first segment 19 of the horizontally-disposed discharge line 18 from the well head connection 14. Preferably, the inlet line 34 is connected to the bottom 35 of the float body 28 and extends upwardly from the bottom into the float chamber 32 to adjacent the top thereof and is provided with a cut-out portion 33 which directs entering fluid away from the float 38.

An outlet line 36 is removably connected, by means not shown, to a second horizontal segment 20 of the discharge line 18 downstream from the float chamber 32 and the first segment 19 and preferably is connected to and extends through the bottom 35 of the float body 28 and opens at or adjacent an upper portion of the float chamber 32. The second segment 20 is connected to a vertical discharge leg 22 provided with a vertically-disposed check valve 24, the vertical leg 22 being in turn connected to a horizontal discharge lege 26 for flow to distination, such as tanks and the like.

A float 38, which is arranged to float vertically up and down with changes in the liquid level, is provided in the float chamber 32 and, preferably, is disposed in a tubular float guide 40 extending from the bottom 35 of the float body 28 to adjacent the top of the float chamber 32 and having the openings 41 at its lower portion for flow of liquid into the float guide 40. Thus, the float 38 is guided in a vertical direction in its travel with changes in liquid levels within the float chamber 32.

It should be noted that the float 38 and the float guide 40 are both located away from and out of the direct path of flow of fluid, either liquid or gas, entering the float chamber 32 through the inlet line 34. Also, the float 38 is shielded from direct flow of the incoming fluid by shield means, such as the float guide 40 and the inlet line 34 with its discharge opening 33 directing entering fluid away from the float 38. Thus, the float 38 is not acted upon adversely by inflow into the float chamber 32 such as surges of oil or gas, as would be the case if the float 38 were located in the path or a portion of the path of fluid flowing through the inlet line 34 into the float chamber 32, and the float 38 were not shielded therefrom.

A drain line 41 is connected to the bottom 35 of the float body 28 for the purpose of permitting the liquid to drain out of the float chamber 32 when liquid is no longer being pumped through the inlet 34 into the float chamber 32 thereby permitting the float 38 to lower. The flow of liquid through the drain line 41 is substantially reduced with respect to the overflow of liquid into the opening at the top of the overflow outlet line 36. Preferably, this is accomplished by the adjustable flow reducing valve 43.

A switch 42 is provided which includes the float contact 44 attached to the upper end of the stem 46 extending through the connecting portion 48 connecting the switch 42 to the top cover 30. Preferably, the switch 42 is removably connected to the top cover 30, by means not shown, and the connector 48 may be suitably packed off to prevent liquid or fluid pressures entering into or acting on the switch 42.

An electric circuit is provided through the switch 42 by the electric contacts 52, 44 and 50 and the conductors 52 and 53 to the power switch 55 provided with the power line 57 and power line 54 to the electric motor of the pump 10, here diagramatically shown and indicated by the reference numeral 56. Thus, when the float 38 is in an upper position as illustrated in the drawing, the float contact 44 closes an electric control circuit through the power switch 57 to the electric motor 56 of pump 10, as described, thereby actuating the pump. While a single phase motor and power circuit for it is shown, it may be a multiphase motor and circuit.

The switch 42 includes the electric contact 58 connected to the conductor 60 which in turn is connected to the timer 64 and its motor 62 for actuation of the timer 64. The timer 64 is provided with means for closing another control circuit to power switch 55 for closing the switch and the power circuit to the motor 56 for predetermined time intervals, here shown as elongated wiper contacts which are periodically brought into electrical engagement with the contact 70 as the motor 62 causes the timer to advance. Thus, when one of the wiper contacts 66 engages the contact 70, as shown in the drawing, the control circuit is closed from the timer 64 through the conductors 68 and 53 to the power switch 55 thereby closing it and closing the power circuit through conductor 54 to the electric motor 56. Thus, when the float 38 is in a lower position in response to a lower liquid level in the float chamber 32, the float contact 44 is similarly lowered and is out of engagement with the contact 50 thereby opening the control circuit through conductors 52 and 53 to the power switch 55 thereby opening the power switch 55 and the power circuit through power conductor 54 to the electric pump motor 56 and is in engagement with the electric contact 58 thereby closing the control circuit to the timer 64 and its motor 62 through the contacts 49, 44 and 58 and through conductor 60. This causes the timer to be energized to actuate the electric motor 62 of the timer 64 and to provide electrical energy to the power switch 55 to close it and the power circuit through conductor 54 to the pump motor 56 through the timer 64, its contact 66, the contact 70, and the control circuit conductors 68 and 53.

In operation, assuming that the pump 10 is not pumping liquid into the discharge line 18, the liquid level in the float chamber 32 will be at a lower or no level, thereby causing the float 38 to be in a lower position. In this connection, through the specification and claims it will be understood that the terms "a low liquid level" or a "lower liquid level" will include no level of liquid in the float chamber 32. When this condition exists, the float contact 44 will be lowered out of engagement with the switch contact 50 and will be in engagement with the switch contact 58 thereby closing a circuit through the conductor 60 to the timer 64 and its motor 62. This energizes the timer and causes it to bring the electric wiper contacts 66 sequentially into engagement with the electrical contact 70 thus closing a control circuit through the conductors 68 and 53 to the power switch 55 thereby closing it and a power circuit through conductor 53 to the electric motor 56 thereby causing the pump 10 to reciprocate the sucker rod string 12 up and down in the cased well 16 for pumping the well. As previously mentioned, the wiper contacts 66 are here schematically shown as elongated to indicate a time interval, say 10 minutes. Any desired time interval may be provided depending upon the pumping conditions of the particular well. Thus, the electric motor 56 will be energized for a total period of 10 minutes through the circuit including the timer 64 withhout pumping any liquid from the well 16. In the event the pump 10 starts pumping liquid from the well 16, the liquid is pumped through the well connection 14 and out the discharge line 18, through the horizontal segment 19 and inlet line 34 onto the bottom 35 of the float chamber 32. Upon continued pumping of liquid the level of the liquid rises in the float chamber 32 until it reaches the overflow point into the outlet line 36 through which it flows from the float chamber 32 into the discharge line segment 20, discharge legs 22 and 26 to destination. The check valve 24 prevents any back flow into the float chamber 32 thus preventing back flow from interfering with the normal operations of the float assembly 27.

The float 38 rises with the liquid level in the float chamber 32 to the position illustrated in the drawing and thus brings the float contact 44 out of engagement with the electrical contact 58 thereby opening the circuit through the conductor 60 to the timer 64 and its motor 62 thus stopping and deenergizing the timer 64. The electric contact 44, however, does close the control circuit through contacts 49 and 50 through conductors 52 and 53 to the power switch 55 closing it and the power circuit through power conductor 53 to the electric motor 56 thus causing the pump 10 to continue pumping liquid. So long as the pump 10 continues to pump liquid, this condition will remain and the timer 64 will be stopped.

As previously mentioned, the float 38, is shielded from and out of the direct path of inflow of fluid, both liquid and gas, into the float chamber 32 by the inlet line 34 and inlet opening 33 facing away from the float 38 together with the float guide 40 so that in the event there are surges of gas, the gas will simply flow into the float chamber 32 through the inlet line 34 and out the outlet line 36 without affecting the movement of the float 38 and its operation.

In the event the well 16 is "pumped off" that is, stops pumping liquid, no more liquid will be pumped into the float chamber 32, but the pumping action will cause the liquid to be pumped through the reduced flow drain line 41 against the backpressure of the check valve 24, thereby causing the liquid level to lower in the float chamber 32 and thus causing the float 38 to lower along with it and move out of engagement with the contact 50 thus opening the control circuit through conductors 52 and 53 to the power switch 55 opening it and the power circuit to the electric motor 56. This also causes the float contact 44 to engage the electrical contact 58 and close the electrical control circuit through the conductor 60 to the timer 64 and its motor 62 thereby actuating the timer 64 as previously described. In the event the pump 10 started pumping liquid from the well 16 in say 5 minutes, there would be 5 minutes of time remaining in which the contact 66 would be in engagement with the contact 70, in the example given, and the electric control circuit from the timer 64 through conductors 68 and 53 to the power switch 55 will be closed thus closing the power switch 55 and the power circuit through conductor 53 to the electric motor 56 thus continuing the pumping of the pump 10 for the remaining time interval. In the event the pump 10 again starts pumping liquid from the well 16 before the end of the time interval, liquid will again be pumped through the inlet line 34 into the float chamber 32 thereby causing the liquid level to again rise and the sequence of operations previously described to be repeated. Thus, the float 38 will again be in the position illustrated in the drawing and the control circuit is closed through conductors 52 and 53 to the power switch 55 thereby closing it and the power circuit to the electric motor 56 thereby causing the pump to continue pumping. When the pump 10 stops pumping liquid from the well 16, the liquid level in the float chamber 32 again lowers and the sequence of operations previously described again occurs. When the well 16 finally pumps off, that is pumps no more liquid, during the time interval set by the timer 64 as indicated by the elongated wiper contacts 66, the remaining pumping action of the pump 10 will pump the liquid out of the float chamber 32 through the drain line 41 as controlled by the reducing valve 43 thereby permitting the float 38 to lower, all as previously described. At this time, the motor 62 of the timer 64 is energized causing the timer 64 to advance bringing the next contact 66 into engagement with the contact 70 after a predetermined time interval to repeat these operations.

It will be understood that any suitable switch arrangement 42 may be utilized which is actuated by the upward and downward movement of the float 38. Also, any suitable timer may be used and any number of pumping cycles may be provided with any desired length of time intervals for actuating the pump 10 and delay time intervals as desired. Such timers and switches are available on the market. For example, a Flexopulse Plug-In Timer, HG100 Series, marketed by Eagle Signal Division of Gulf & Western Industries, Inc. is satisfactory.

From the foregoing description, it is seen that the pump control is actuated by the liquid actually being pumped, that flow or surges of gas or liquid to not adversely affect its operation, and that it is not actuated in response to the pumping action of the pump 10, which is affected by the geometry of its parts, and does not utilize a sensing element which is adversely affected by vibrations, coatings by paraffin, asphalt or other substances in the liquid being pumped, and by wet gas.

Accordingly, the present invention is well suited and adapted to attain the objects and ends and has the advantages and features mentioned as well as others inherent therein.

While the presently-preferred embodiment of the invention is given for the purpose of disclosure, changes in details and arrangement of parts may be made which are within the spirit of the invention as defined by the scope of the appended claims.

What is claimed is:

1. A pump control for a pump driven by an electric motor for pumping liquid from a well through a discharge line comprising, a float body having a float chamber, a float in the float chamber, an inlet line connected to and extending upwardly from the bottom of the float chamber to adjacent its top and provided with an opening directing inflow of liquid away from the float, the inlet line attachable to a first segment of the discharge line, an outlet line connected to and extending upwardly through the bottom of the float and having an opening spaced above the bottom of the float chamber and attachable to a second segment of the discharge line downstream from the first segment whereby liquid in the discharge line is pumped through the first segment, the inlet line into the float chamber and out the outer line into the second segment of the discharge line and establishes an upper liquid level in the float chamber, a drain line adjacent the bottom of the float arranged to drain liquid out of the float chamber and to establish a lower liquid level in the float chamber, the float in the float chamber being disposed out of the direct flow path of fluid entering into the float chamber and arranged for vertical movement with changes in the level of liquid in the float chamber, a float guide having openings at its lower portion extending vertically upwardly from the bottom to adjacent the top of the float chamber out of the direct flow path of fluid entering into the float chamber surrounding the float and guiding the float in its vertical movement and shielding the float from surges of gas, an energizing electric circuit for the electric motor, a timer in the circuit arranged to periodically close the circuit to the electric motor for predetermined intervals of time, and a switch actuated by the vertical movement of the float and arranged to close the circuit to the electric motor and to open the circuit to the timer when the float is in an upper position in response to the upper liquid level and to open the circuit to the motor and to close a circuit to the timer when the float is in a lower position in response to the lower liquid level in the float chamber.

2. The pump control of claim 1 where the inlet line is connected to and extends upwardly from the bottom to adjacent the top of the float chamber and is provided with an opening directing inflowing liquid away from the float, and the outlet line is connected to and extends upwardly through the bottom into the float chamber.

3. The pump control of claim 2 where the inlet and outline lines provide support for the pump control.

4. A pump control for a pump driven by an electric motor for pumping liquid from a well through a discharge line, at least a portion of which extends horizontally, and which includes a check valve disposed in the discharge line, the pump control comprising, a float body having a float chamber, an inlet line into the float chamber connected to its bottom extending upwardly to adjacent its top and attachable to a first segment of the horizontal portion of the discharge line and upstream from the check valve, said inlet line provided with an inlet opening adjacent its top, an outlet line from the float chamber, connected to and extending upwardly from the bottom and having an opening spaced above the bottom of the float chamber, the outlet line being attachable to a second segment of the horizontal portion of the discharge line upstream from the check valve and downstream from the first segment whereby liquid in the discharge line is pumped through the first segment, the inlet line into the bottom of the float chamber and overflows into the outlet line to the second segment of the discharge line and establishes an upper liquid level in the float chamber, a drain line adjacent the bottom of the float chamber arranged to drain liquid out of the float chamber and to establish a lower liquid level in the float chamber, a float in the float chamber disposed out of the direct inlet flow path into the float chamber and arranged for vertical movement with changes in the level of liquid in the float chamber, a float guide having openings at its lower portion extending vertically upwardly from the bottom of the float chamber out of the inlet flow path and surrounding and guiding the float in its vertical movement, the inlet line and the float guide arranged to shield the float from direct flow of fluid into and surges of gas in the float chamber, an energizing electric circuit for the electric motor, a timer in the circuit arranged to periodically close the circuit to the electric motor for predetermined intervals of time, and a switch actuated by the vertical movement of the float and arranged to close the circuit to the electric motor and to open the circuit to the timer when the float is in an upper position in response to the upper liquid level and to open the circuit to the motor and to close the circuit to the timer when the float is in the lower position in response to the lower liquid level in the float chamber.

5. The pump control of claim 4 where the drain line is arranged to provide reduced flow from the float chamber with respect to flow in the outlet line.

6. The pump control of claim 5 where the drain line is connected to the second segment of the discharge line.

7. The pump control of claim 5 including a top cover secured to the float body, and a float stem extending upwardly from the float and movably through the top cover for actuating the switch.

8. The pump control of claim 7 where the switch is carried by the top cover.

9. The pump control of claim 8 where the inlet and outlet lines support the pump control.

* * * * *